US007267638B2

(12) United States Patent
Wang

(10) Patent No.: US 7,267,638 B2
(45) Date of Patent: Sep. 11, 2007

(54) PACE-ADJUSTING MECHANISM OF AN ELLIPTICAL CROSS TRAINER

(76) Inventor: Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 82 days.

(21) Appl. No.: 11/262,451

(22) Filed: Oct. 31, 2005

(65) Prior Publication Data

US 2007/0099763 A1 May 3, 2007

(51) Int. Cl.
*A63B 69/16* (2006.01)
*A63B 22/04* (2006.01)

(52) U.S. Cl. ..... 482/52; 482/57

(58) Field of Classification Search ..... 482/52, 482/57, 70, 79–80

See application file for complete search history.

(56) References Cited

U.S. PATENT DOCUMENTS 5,242,343 A * 9/1993 Miller ..... 482/57
5,924,962 A * 7/1999 Rodgers, Jr. ..... 482/57
6,440,042 B2 * 8/2002 Eschenbach ..... 482/52
7,060,005 B2 * 6/2006 Carlsen et al. ..... 482/52

* cited by examiner

*Primary Examiner*—Stephen R. Crow
(74) *Attorney, Agent, or Firm*—Troxell Law Office, PLLC

(57) ABSTRACT

A pace-adjusting mechanism of an elliptical cross trainer having an electric adjusting mechanism installed at the bottom of a front side of the frame unit. The electric adjusting mechanism includes a motor, a guide spindle sleeve, a telescopic spindle, a slide bar, a U-frame and two connecting rods. Both connecting rods are pivotally coupled to the front end of the treadle plank. The U-frame is pivotally mounted on the frame unit. When the guide spindle sleeve is driven by the motor to create a reciprocating in-place displacement of the telescopic spindle, it results in a change of the connecting angle between the slide bar and the U-frame. In this way, the U-frame changes its supporting angle. Then, the vertical position of the treadle plank and the treadle thereon can be adjusted by the coupling relationship of the connecting rods. Accordingly, the change of the exercise pace can be achieved.

1 Claim, 3 Drawing Sheets

PACE-ADJUSTING MECHANISM OF AN ELLIPTICAL CROSS TRAINER

BACKGROUND OF THE INVENTION

1. Fields of the Invention

The invention relates to a pace-adjusting mechanism of an elliptical cross trainer, and more particularly, to a mechanism that can rapidly adjust the movement pace at will.

2. Description of the Related Art

The elliptical cross trainer is so used that the operator's feet can make an elliptical movement path, thereby simulating the real running and walking path. Moreover, the horizontal pace (simulating the movement on a flat ground) and the inclined pace (simulating the uphill and downhill movement) can be changed when the vertical position of the treadles of the elliptical cross trainer changes. This is the main intention of the invention.

U.S. Pat. No. 6,090,013 discloses such a mechanism that employs a plurality of selection holes in treadle planks. By selecting a desired hole in the treadle plank for connection, the coupling angle of the treadle plank can be changed to achieve the above-mentioned pace-adjusting effect.

In fact, the manual adjustment of the aforementioned prior art is not a practical solution. This is because the operator has to stop the exercise for adjustment of the movement pace, thereby reducing the desire of using the elliptical cross trainer. Meanwhile, this adjustment way must affect the exercise rhythm. Thus, it is hardly possible to use the pace-adjusting mechanism during the exercise sessions so that this kind of the pace-adjusting mechanism is not so practical and valuable as expected.

SUMMARY OF THE INVENTION

It is a primary object of the invention is to provide a pace-adjusting mechanism of an elliptical cross trainer that employs an electric adjusting mechanism instead of a manual adjusting mechanism. In this way, the operator can easily perform a desired adjustment during the exercise session without stopping the exercise and affecting the movement rhythm. Accordingly, the pace-adjusting mechanism of an elliptical cross trainer can be easily and practically used.

In order to achieve the above-mentioned object, an electric adjusting mechanism is employed to ensure a change of the supporting angle of a U-frame relative to a frame unit pivotally coupled thereto. Meanwhile, connecting rods are pivotally connected to treadle planks, respectively, thereby adjusting the position of the treadles and changing the movement pace.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
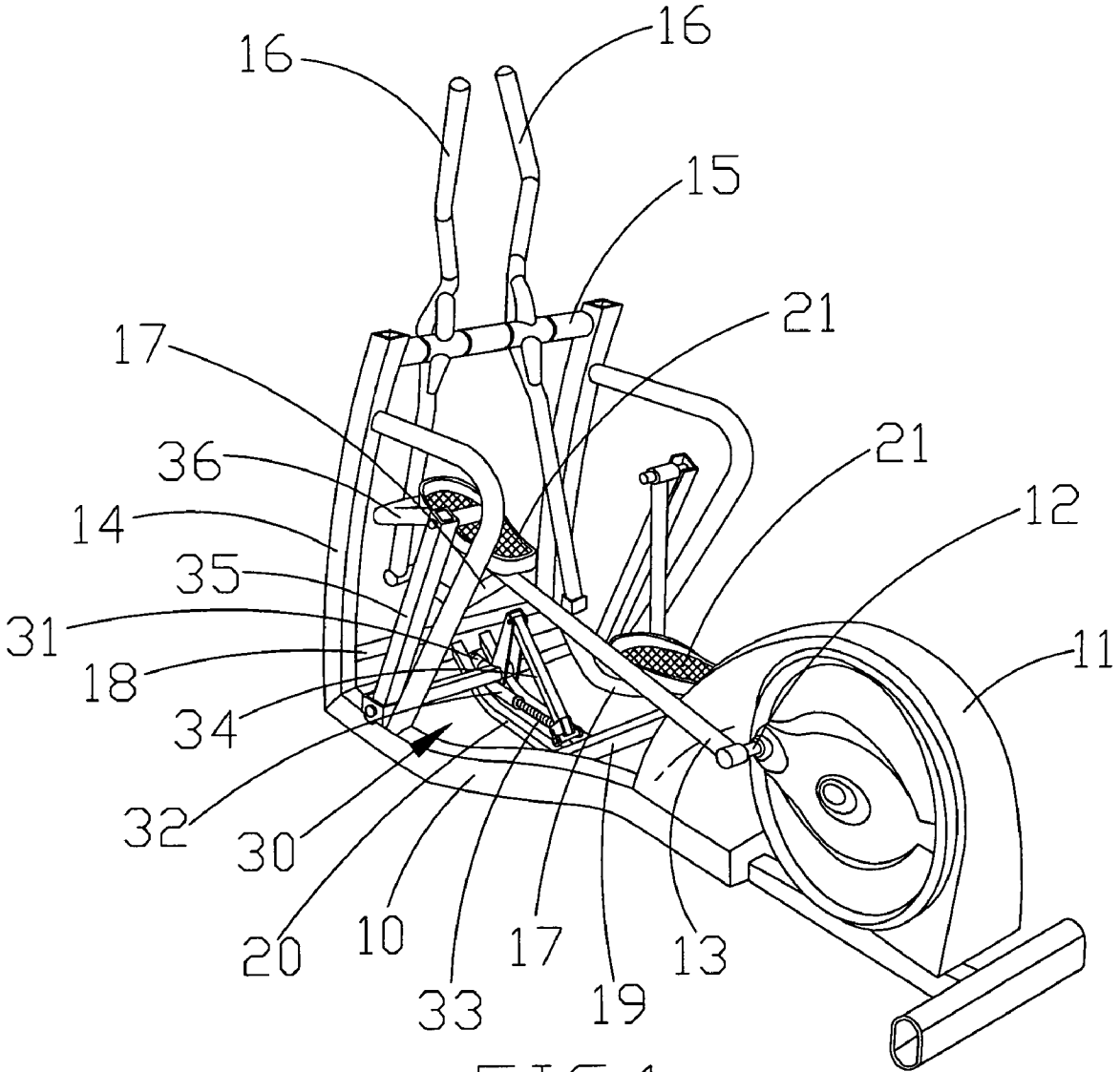
FIG. 1 is a perspective view of a preferred embodiment of the invention.
Figure 2:
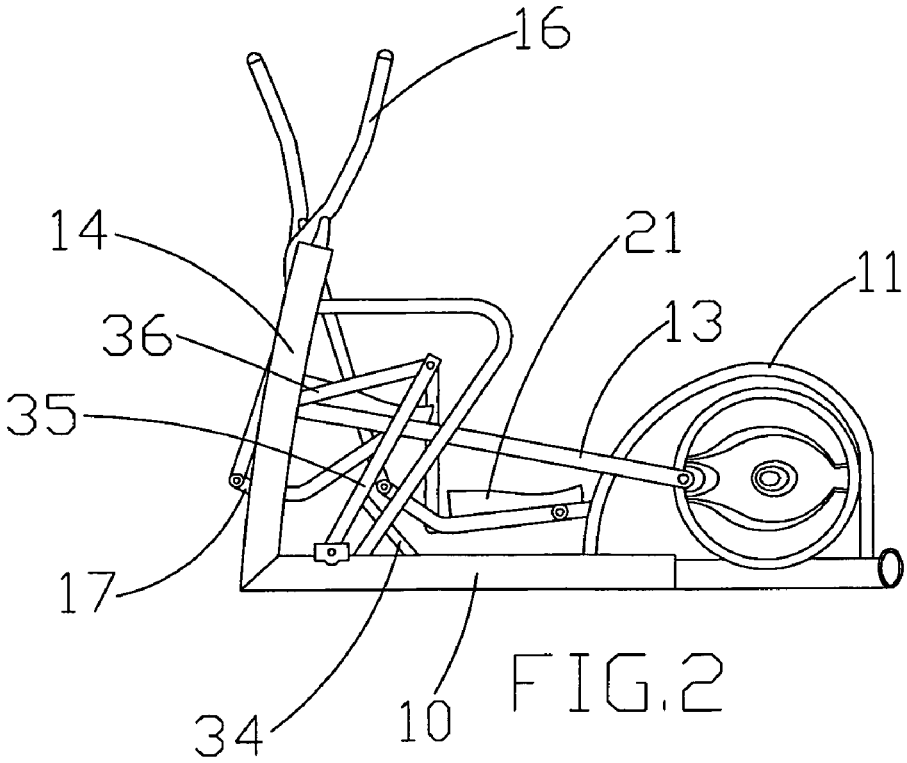
FIG. 2 is a side view of the embodiment of FIG. 1.
Figure 3:
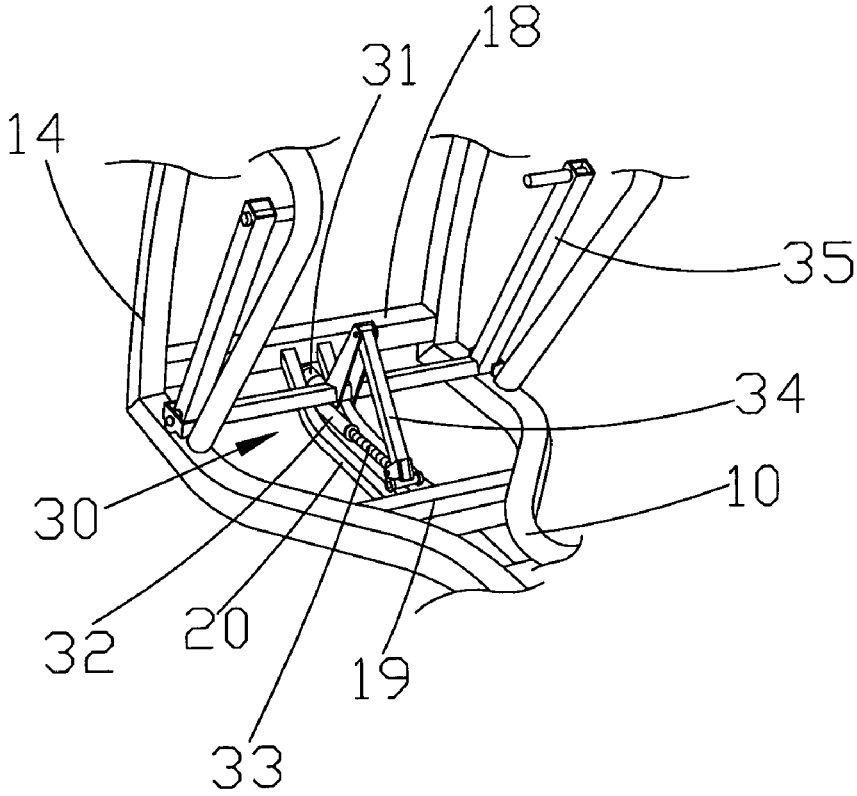
FIG. 3 is a partial enlarged perspective view of the embodiment of FIG. 1.

Referring to FIGS. 1 through 3, a preferred embodiment of the invention includes a frame unit 10 and an electric adjusting mechanism 30.

The frame unit 10 has a rear end on which a flywheel transmission unit is placed. The flywheel transmission unit is covered by a protection hood 11 so that it is hidden in the figures. The flywheel transmission unit includes a crank 12 at both sides thereof that is pivotally coupled to a corresponding treadle plank 13. The elliptical cross trainer has two upright posts 14 at the front end thereof between which a cross bar 15 is extended. Two handles 16 are pivotally attached to the cross bar 15. A bend 17 is pivotally coupled to a bottom end of the handles 16, respectively. Moreover, the opposing end of the bend 17 is pivotally coupled to a bottom end near the front section of the treadle plank 13. In this way, the components are coupled in such a way that they can be synchronically moved. Furthermore, two parallel bars 20 are interposed between a second crossbar 18 and a third crossbar 19.

The electric adjusting mechanism 30 is installed at the bottom of a front side of the frame unit 10. The electric adjusting mechanism 30 includes a motor 31, a guide spindle sleeve 32, a telescopic spindle 33, a slide bar 34, a U-frame 35 and two connecting rods 36. Both connecting rods 36 are pivotally coupled to the front end of the treadle plank 13. The U-frame 35 is pivotally mounted on the frame unit 10.

As shown in FIGS. 2 through 5, when the guide spindle sleeve 32 is driven by the motor 31 to create a reciprocating in-place displacement of the telescopic spindle 33, it results in a change of the connecting angle between the slide bar 34 and the U-frame 35. In this way, the U-frame 35 changes its supporting angle. Then, the vertical position of the treadle plank 13 and the treadle 21 thereon can be adjusted by the coupling relationship of the connecting rods 36. Accordingly, the change of the exercise pace can be achieved.

Besides, the motor 31, the guide spindle sleeve 32 and the telescopic spindle 33 are mounted between both parallel bars 20 of the frame unit 10. Therefore, the slide bar 34 is stably movable on the parallel bars 20 to ensure a stable operation.

Figure 4:
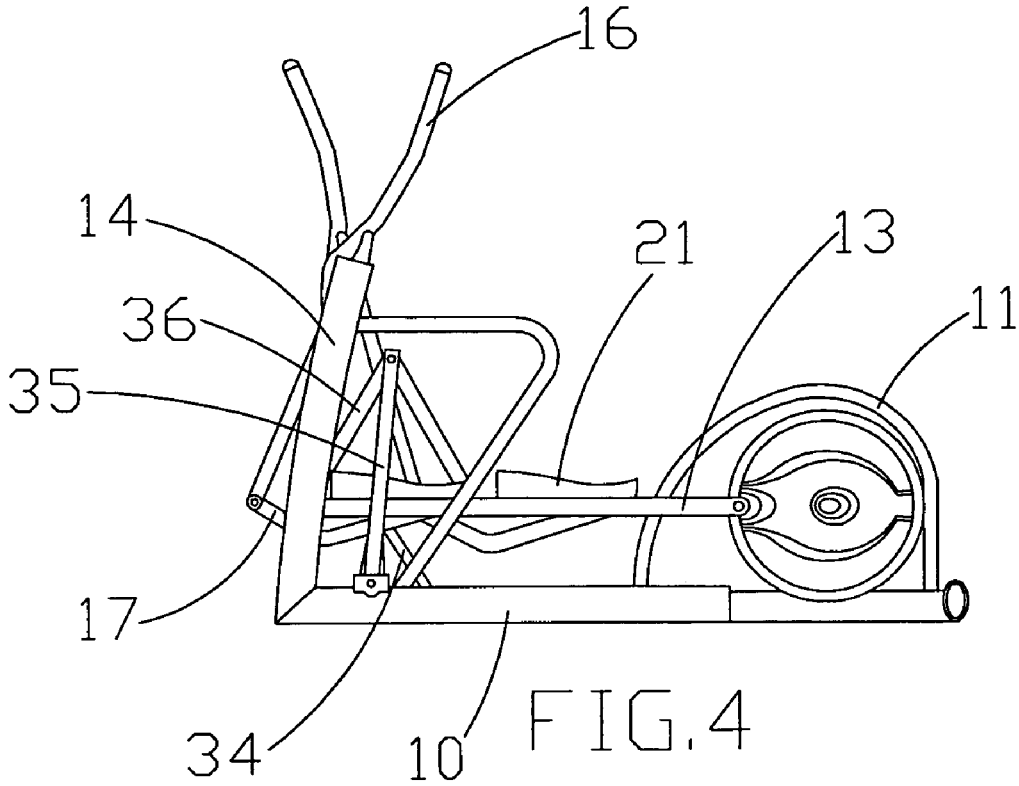
FIG. 4 is a side view of the embodiment of FIG. 2 after adjustment.
Figure 5:
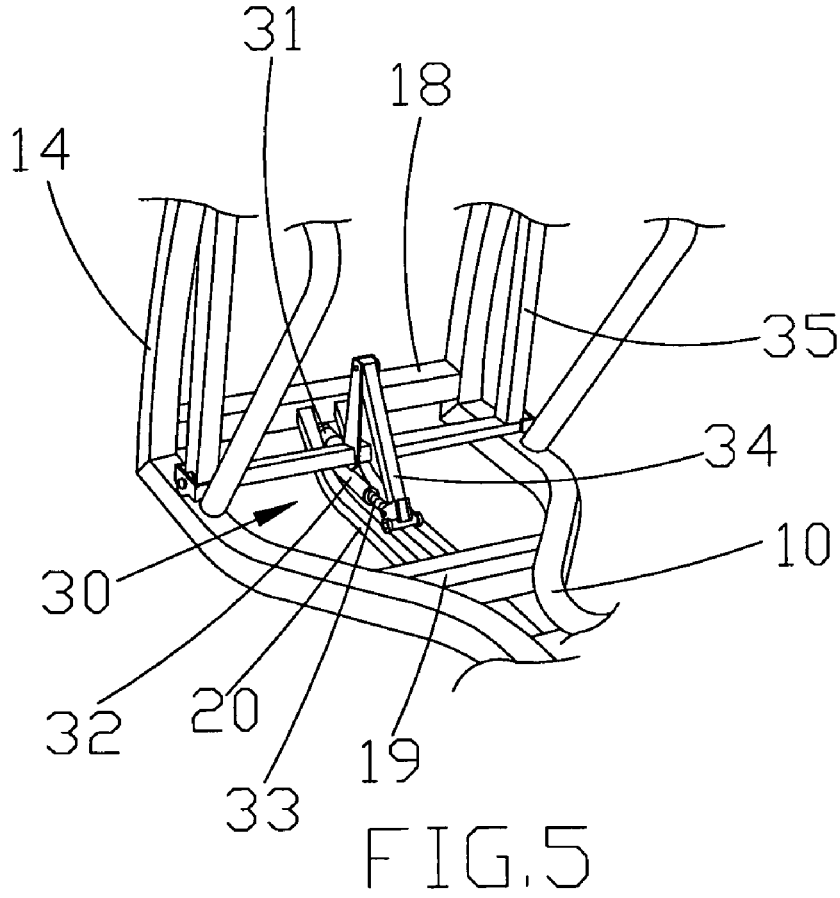
FIG. 5 is a partial enlarged perspective view of the embodiment of FIG. 3 after adjustment.

In order to further show the operation features of the electric adjusting mechanism 30, the treadle planks 13 and the connecting rods 36 are deliberately removed out of FIGS. 3 and 5 to make clear the coupling relationship among the telescopic spindle 33, the slide bar 34 and the U-frame 35. In addition, FIGS. 2 and 4 show the change of the relative position of the treadle plank 13 and the treadle 21 thereon. Accordingly, it's clear that the invention can achieve the expected adjustment effect so that the operator can easily have great fun using the elliptical cross trainer in accordance with the invention.

By the way, it has to be pointed out that the treadle plank 13 and its related components only at one side of the elliptical cross trainer are marked with reference signs to prevent the unnecessary confusion in reading.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claim.

What is claimed is:

1. An elliptical exercise device having a pace-adjusting mechanism, comprising:

a) a frame unit having a rear end on which a flywheel transmission unit is placed, the flywheel transmission unit including a crank at both sides thereof that is pivotally coupled to a corresponding treadle plank, the elliptical cross trainer having two upright posts at the front end thereof between which a cross bar is extended, two handles being pivotally attached to the cross bar, a bend being pivotally coupled to a bottom end of each of the two handles, respectively, the opposing end of the bend being pivotally coupled to a bottom end near the front section of the treadle plank such that corresponding sets of the crank, the treadle plank, one of the two upright posts, one of the two handles, and the bend move synchronously, the elliptical cross trainer further having two parallel bars interposed between a second crossbar and a third crossbar; and b) an electric adjusting mechanism installed at the bottom of a front side of the frame unit and having a motor, a guide spindle sleeve, a telescopic spindle, a slide bar, a U-frame and two connecting rods, both connecting rods being pivotally coupled to the front end of the treadle plank, the U-frame being pivotally mounted on the frame unit, wherein, when the guide spindle sleeve is driven by the motor to create a reciprocating in-place displacement of the telescopic spindle, a connecting angle between the slide bar and the U-frame is changed; and a supporting angle of the U-frame is changed and the vertical position of the treadle plank and the treadle thereon is adjusted by the coupling relationship of the connecting rods thereby changing an exercise pace.

* * * * *